US005411294A

United States Patent [19]

Diemert

[11] Patent Number: 5,411,294

[45] Date of Patent: May 2, 1995

[54] STRIP BAGGAGE TAG IN ENDLESS OR ROLL FORM FOR MACHINE PRINTING

[75] Inventor: Kurt Diemert, Gleisweiler, Germany

[73] Assignee: Fix GmbH, Landau/Falz, Germany

[21] Appl. No.: 961,472

[22] Filed: Oct. 15, 1992

[30] Foreign Application Priority Data

Oct. 16, 1991 [DE] Germany ..... 41 34 252.6

[51] Int. Cl.[6] ..... B42D 15/00

[52] U.S. Cl. ..... 283/67; 283/80; 281/5; 40/630; 40/6

[58] Field of Search ..... 281/5, 2; 156/250; 462/7, 8, 900, 901; 283/79, 80, 81, 62, 67; 40/299, 330, 630, 6; 428/40–42

[56] References Cited

U.S. PATENT DOCUMENTS

| | | | |
|---|---|---|---|
| 3,228,129 | 1/1966 | Gwinn et al. | 283/80 |
| 4,666,185 | 5/1987 | Pilborough | 283/80 |
| 5,145,211 | 9/1992 | McKillip | 283/80 |

FOREIGN PATENT DOCUMENTS

| | | |
|---|---|---|
| 3841039 | 6/1989 | Germany . |
| 9110080 | 11/1991 | Germany . |

*Primary Examiner*—Willmon Fridie

*Attorney, Agent, or Firm*—Ostrolenk, Faber, Gerb & Soffen

[57] ABSTRACT

A strip baggage tag (1) is formed in endless or roll form for facilitating machine printing. It includes a tag part (6) which is to be fastened to a bag, and a control section (7). The control section (7) comprises a tear-off part (4'') which can be detached from the tag part (6) along a transversely extending separation line (8). Both the tag part (6) and the tear-off part (4'') have, on their back, an adhesive area (10) which is coated with pressure-sensitive adhesive and extends on both sides of the separation line (8). The adhesive area (10) is covered by a single-piece lower-web section (5) bearing a separation-active coating, for instance of silicone, the width of which section corresponds to that of the upper web (4). The lower-web section (5) has, in the region of the adhesive area associated with the tear-off part (4''), a separation-inactive partial region (11) which permits a firm bonding. This partial region (11), which may be made separation-inactive for instance by corona treatment, forms an attachment bridge to make a firm connection between the web section (5) and the tear-off part (4''), both of which together form the control section (7) which can be adhered to a plane ticket jointly, after exposure of a part of the adhesive area (10) for identifying an article of baggage.

13 Claims, 3 Drawing Sheets

58
57
48
49
50
52
51
56
54
47
45
46
40
43
44
42
41
1
2
55
L
l
10
3
12
53

STRIP BAGGAGE TAG IN ENDLESS OR ROLL FORM FOR MACHINE PRINTING

CROSS-REFERENCE TO RELATED APPLICATION

This application is related to the commonly assigned application filed on even date herewith in the name of Kurt Diemer, titled STRIP BAGGAGE TAG (Attorney Docket FA-1428 (1624-8)), the disclosures of which are incorporated by reference herein.

BACKGROUND OF THE INVENTION

The present invention relates to a strip baggage tag which is formed in endless or roll form for facilitating machine printing, of a type which includes a control section, and a tag part which is to be attached to an item of baggage.

In order to identify passengers' baggage while they are travelling on a means of transportation, particularly in international air travel, baggage tags are used which consist essentially of two parts, namely a tag part which can be attached to a particular bag, and a control section which makes it possible to identify the bag and is turned over to the person checking the baggage.

The control section is generally developed as a tear-off part which can be torn off from the tag part along a transversely extending separation line or separation perforations. The backs of both the control section and the tag part are provided with a pressure-sensitive adhesive. The layer of pressure-sensitive adhesive must first of all be covered by a web coated with a separating agent, for instance a silicone paper, in order to maintain the adhesive capable of use. In this way, the control section can, after detachment, be fastened by means of the adhesive layer to or in a passage ticket. The tag part which is to be attached to the bag, after exposing the adhesive layer, is placed around the handle of the bag in question by forming it into a loop and bonding it to itself.

The known strip baggage tags have the disadvantage that, in order to activate the pressure-sensitive adhesive, the protective papers which are coated with separating agent must be removed and disposed of. Since this work is generally carried out at the time of check-in at the airline counter under the pressure of time, the possibility cannot be excluded that such papers will fall on the floor and, due to their smooth surface, result in increased danger of accidents due to slipping on them.

Another disadvantage is that, when the one part of the strip baggage tag is attached as a loop to the bag, the surface provided with the pressure-sensitive adhesive is frequently brought together hastily and inaccurately with the facing surface, so that exposed regions of the adhesive layer which are not covered by a corresponding facing surface remain, particularly at the edges. There is thus the danger that these regions will stick to other bags. In such case, the upper web of the tag part, which consists of tear-resistant material, can detach itself from the lower web which is coated with the separating agent and which is not able by itself to assure resistance to tearing, so that the tag may become detached from the bag.

A plurality of such strip baggage tags are customarily produced alongside each other in wide webs and only subsequently are cut into narrow webs, each having a tag, webs being made available to the user, attached to each other, in endless or roll form. The tags are then printed on from the stack or roll by a printer, generally by a thermal printer. Only then are they separated into individual tag lengths. As a result of being manufactured in wide webs, the coating of adhesive is generally applied continuously. Thus, it extends up to the longitudinal edges of the tag, leading to the danger, upon printing in the printer, that the pressure-sensitive adhesive will soften as a result of the action of the heat in the printer and small quantities of the adhesive will ooze out laterally, contaminating and damaging the printer. In order to prevent this, it is necessary to "edge" the wide webs before cutting, i.e., to stamp out narrow strips from the upper web on both side of the subsequent cut edges, without, however, damaging the lower web. This additional work is complicated and increases the cost of the mass-produced article, the strip baggage tag.

In order to avoid the necessity of disposing of silicone-coated parts as waste, a known baggage tag has the control section is developed as a tear-off part which can be detached along a line of perforations, adhesive layers are arranged both below the tear-off part as well as below the tag part, and the adhesive layers are covered by a silicone-coated cover strip (DE-U 91 10 080). All prior art materials mentioned herein are expressly incorporated by reference. In this tag, the silicone coatings leave uncoated transversely extending marginal strips on the cover strip so that, after the detaching of the control section from the tag part, silicone-coated parts of the cover strip remain attached on both the tear-off part and the tag part; and in order to expose the adhesive layers, these parts are folded around the edges between the silicone-coated and the uncoated surfaces.

The separation-active webs for the protection of coatings of pressure-sensitive adhesive are ordinarily formed by a silicone coating which forms a closed surface in which an adhesive cannot anchor itself. For reasons of environmental protection, a silicone coating is applied today in aqueous solution, which means very long drying paths in the production process. Interruptions in the silicone coating are thus not only difficult to produce but it is also difficult, after bringing the webs together, to precisely associate continuous regions of the silicone-coated web with the corresponding regions of the web of material, namely the adhesive areas.

SUMMARY OF THE INVENTION

Based on the consideration that, in the case of a baggage tag, both the method of manufacture and the handling by the user must be considered as aspects of a complex system in combination with the product itself, an object of the invention is to develop a baggage tag wherein there are no parts coated with separating agent which must disposed of; wherein the production of the individual tags is simplified; wherein the easy application of printing to the tag part, the control section, and possibly further parts is made possible; and, finally, wherein the handling of the baggage tag at the counter is simplified.

These and other objects can be achieved by a strip baggage tag in endless or roll form for facilitating machine printing having a control section, and having a tag part which is to be fastened to a bag. The control section comprises a tear-off part which can be detached from the tag part along a transversely extending separation line. Both the tag part and the tear-off part are provided, on the back, on both sides of the separation line, with adhesive areas which are coated 10 with pressure-sensitive adhesive. The adhesive areas are covered by web parts which have been made separation-active by coating with a separating agent. Advantageously, the adhesive areas may be covered by a single-piece lower-web section, the width of which corresponds to that of the upper web, and which, at least in the region of the adhesive area of the tear-off part, has at least one partial region which is separation-inactive and provides a firm bond between the tear-off part and the lower-web section.

According to an advantageous method of producing a baggage tag of the aforementioned type, in a continuous process, a web of material, the width of which is at least a multiple of the width of the individual strip baggage tags to be produced, and which comes from a roll, may be first thermosensitively coated and/or printed on the front side. Thereupon, the adhesive forming the adhesive areas is applied; the web sections which are provided with a separation-active coating, except for the partial regions, are fed from the back of the web of material and combined with the web of material; and finally, the web of material is cut in its longitudinal direction into individual strips.

Viewed against this background, a feature of particular importance is that the protective web is first of all coated continuously with separation-active coating and then subjected, in partial regions, to a corona treatment in order to eliminate the separation activity in those regions.

In such a corona treatment, which is known per se in the converting and printing industry, the web to be treated is passed between two electrodes, one of which is developed as support roll. In the discharge slot formed between these two electrodes, high electric voltage is applied as a fine discharge both very uniformly and gently to the surface of the web. By such a treatment, which can be incorporated in the course of manufacture of the baggage tags even in the case of high speeds of passage, it is possible so to treat stripwise regions in a continuously separation-active coated web, so that their separation activity is eliminated at least until the webs are brought together.

As a whole, the invention permits economical and therefore price-favorable manufacturing of strip baggage tags in accordance with the specifications of the airlines, since both the coating of pressure-sensitive adhesive and the protective layer necessary for the protection thereof can be applied in strip form or as a "spot" in the printer. Coding in the form of a bar code can possibly also be applied at the same time.

Other features and advantages of the present invention will become apparent from the following description of embodiments of the invention with reference to the accompanying drawings.

BRIEF DESCRIPTION OF THE DRAWINGS

The invention will be explained in further detail below on basis of the embodiments shown in the drawings, in which.

DETAILED DESCRIPTION OF EMBODIMENTS OF THE INVENTION

Figures 1, 2, 3, 4, 5A, 5B:
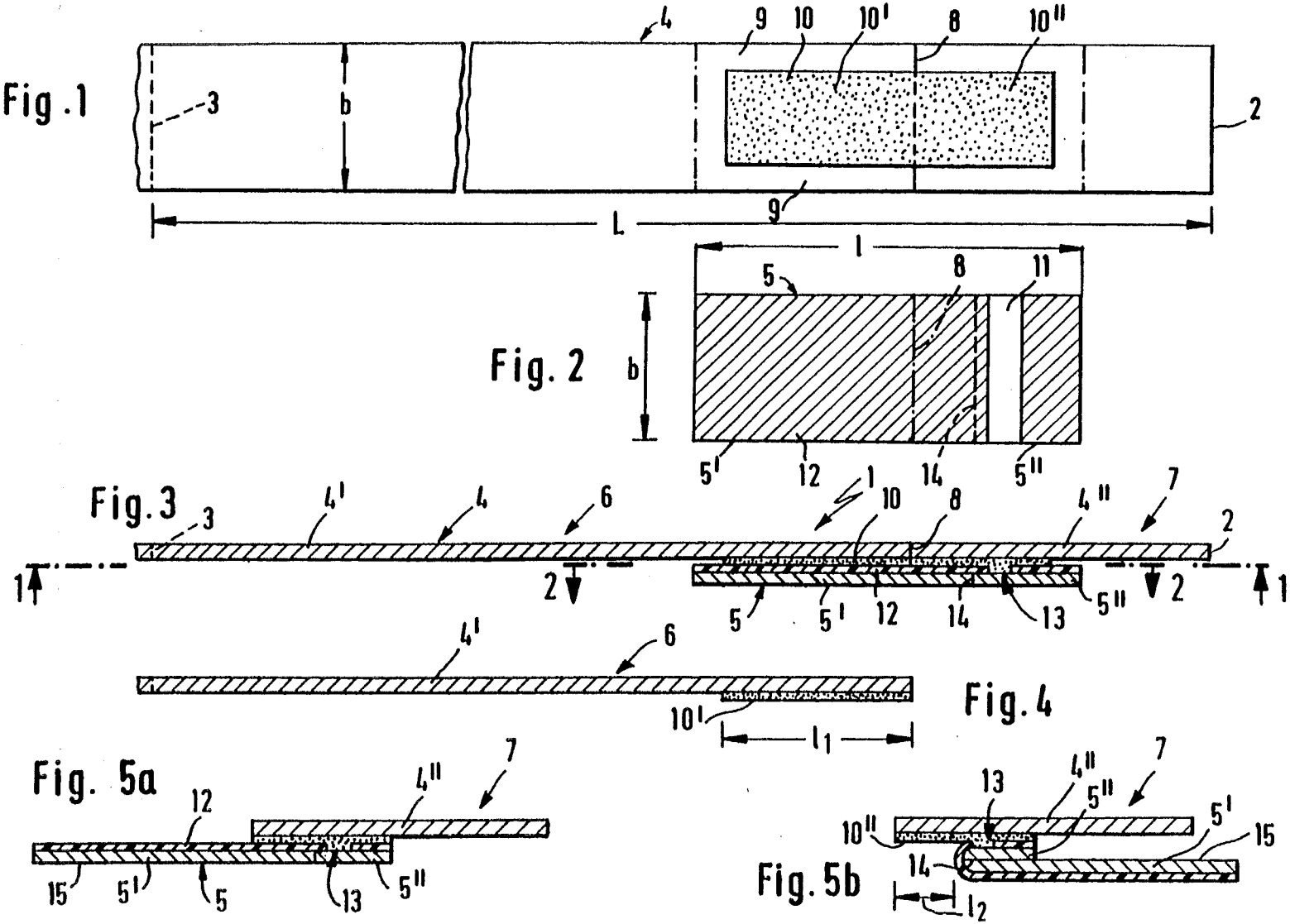
FIG. 1 a bottom view of the upper web of a first embodiment of a strip baggage tag, seen in the direction of the arrows 1 in FIG. 3.
FIG. 2 is a top view of the corresponding lower-web section, seen in the direction of the arrows 2 in FIG. 3.
FIG. 3 is a longitudinal section through the webs which have been brought together to form the strip baggage tag.
FIG. 4 is a longitudinal section through the tag part which is to be attached to the bag after removal of the control section.
FIGS. 5*a* and 5*b* are longitudinal sections through the detached control section in different states of use.

A first embodiment of the a strip baggage tag in accordance with the invention is shown in longitudinal section in FIG. 3 and in top view in FIGS. 1 and 2. The strip baggage tag 1 is developed as a section of an endless stack or a roll, the individual tags 1, which follow each other in the stack or roll, being separated from each other in each case by separation perforation lines. One such perforation line 2 along which the preceding tag was detached adjoins the tag 1, as shown on the right side in the figure; at the opposite perforation line 3, the tag 1 is still attached to the stack or roll.

The strip baggage tag 1 comprises a continuous upper web 4 and a lower-web section 5 which serves as a protective covering. The strip baggage tag 1 comprises a tag part 6 and a control section 7. The control section 7 comprises a tear-off part 4'' which can be detached from the tag part 6 along a transversely extending separating line 8 provided in the upper web 4, for instance a separation cut or a separation perforation. In order to facilitate subsequent printing on the upper web 4, the upper web 4 can have a thermosensitive coating on its front side (the top side in FIG. 3).

In the embodiment shown, the upper web 4, as the bottom view of FIG. 1 shows, is coated with a pressure-sensitive adhesive which forms an adhesive area 10 only on both sides of the separation line 8, leaving narrow marginal zones 9 free. The substantially homogeneous adhesive area 10 can also be applied in a continuous process with dispersion glue by means of an ordinary glue dispenser head.

The lower-web section 5, which has the same 10 width b as the upper web 4, is coated over its entire surface, with the exception of a transversely extending deactivated or uncoated region 11 (described below), with a separating agent 12, for instance silicone. The lower-web section 5, which for reasons of safety is somewhat longer than the adhesive area 10, covers the adhesive area 10 so as to protect it. The separation-inactive region 11, as soon as it comes into contact with the pressure-sensitive adhesive in the adhesive area 10, produces a firm bonding of the lower-web section 5 to the tear-off part 4'', which bonding can be referred to as an attachment bridge 13.

To prepare strip baggage tag 1 for use, the strip baggage tag 1 is preferably written on, for instance by a printer, in particular a thermal printer, while it is still attached to the stack or roll. It is detached automatically or manually along the separation line 3. The strip baggage tag 1 is then gripped by hand by the tag part 6 and on the control section 7, and detached along the separation line 8 in the upper web 4.

The tag part 6 thus produced is shown in longitudinal section in FIG. 4. It comprises the upper-web section 4' and has, on the bottom side at its right-hand end, extending over the length $L_1$, a free activated adhesive surface 10', by means of which the tag part 6 can be bonded to itself so as to form a loop. Even if the bonding is effected hastily and therefore somewhat inaccurately, sufficient play is present due to the fact that the edge zones 9 are free of adhesive, in order to prevent any free adhesive surfaces from remaining exposed.

The control section 7 (FIG. 5*a*) comprises the tear-off part 4'' of the upper web 4 which is detached along the separation line 8 and to which the right-hand part 5'' of the lower web adheres firmly via the attachment bridge 13. Below the tear-off part 4'' there is provided the right-hand lower web part 5'' which has a transversely extending bend perforation line 14, along which the left-hand part 5' of the lower-web section 5 having a separation-active coating can be bent by 180° in the manner shown in FIG. 5*b*. After bending in this fashion, as shown, the adhesive surface 10'' is exposed over the length $L_2$, whereby the control section 7 can be attached to an airplane ticket, for instance, by means of that adhesive surface 10''.

Thus, the first embodiment of the invention provides separation-activity without having any part coated with separating agent which must be disposed of. Furthermore, the lower side of the lower-web section 5, which becomes the upper side by being bent by 180°, can also be meaningfully used, for instance for an imprinted advertisement 15 (FIG. 5*b*).

FIGS. 6 to 10 show a second embodiment of a strip baggage tag according to the invention. This strip baggage tag 21 is also to be considered as being a section of an endless stack or a roll and is limited on the right-hand side in FIG. 6 by a perforation line 22 and on the left side by a perforation line 23. The strip baggage tag 21 comprises a continuous upper web 24. A lower-web section 25 of length L extends below adhesive areas 29, 30 which are arranged, for the subsequent gluing together, on the bottom of the tag part 26 on the one hand and on the bottom of the control section 27 on the other hand. These adhesive areas are shown individually in FIG. 6, which is a bottom view of the upper web 4 before application of the lower-web section 25.

Figure 6:
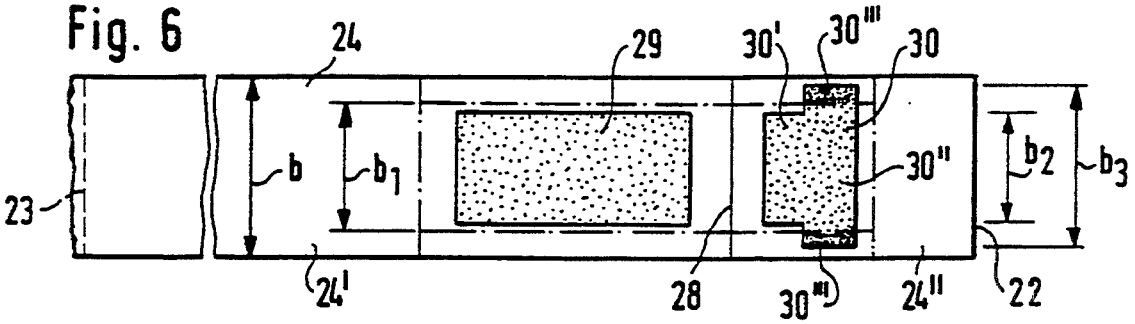
FIG. 6 is a bottom view of the upper web of a second embodiment, seen in the direction of the arrows 6 in FIG. 8.
Figure 8:
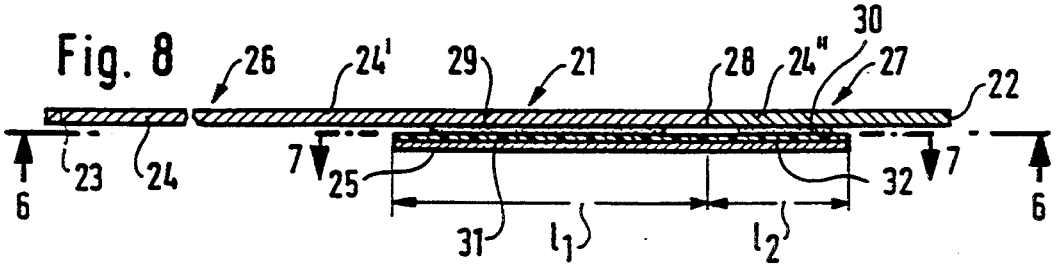
FIG. 8 is a longitudinal section through the webs which have been brought together to form the strip baggage tag.
Figure 7:
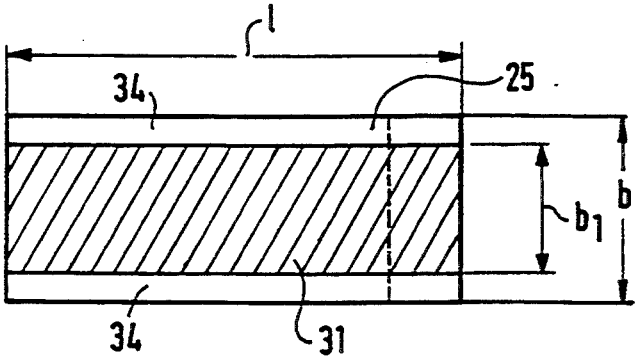
FIG. 7 is a top view of the corresponding lower web section, seen in the direction of the arrows 7.

Adhesive areas are present on both sides of the separation line 28. That is, on the one hand, an adhesive area 29 is applied to the bottom of the upper-web section 24' associated with the tag part 26, and an adhesive area 30 is applied to the bottom of the upper-web section 24'' which is associated with the control section 27 and forms a tear-off part. As shown in Fig. 6, the width $b_2$ of the adhesive area 29 is slightly less than that of the region 31 with the separation-active coating on the lower-web section 25, the width of which is indicated by $b_1$. Thus, separation-inactive edge regions 34 remain along the longitudinal edges, in which a firm bond can be formed. For this purpose, the adhesive area 30 has two regions, namely a narrower region 30' the width $b_2$ of which corresponds to that of the adhesive area 29, and a wider region 30'', the width $b_3$ of which is greater than the width $b_1$ of the separation-active region but, of course, less than the width b of the strip baggage tag 21 itself. In this way, it is assured that the web section 25 having the separation-active coating 31 can be pulled off, so as to permit exposure and activation of the narrow adhesive area 29 and of the narrower region 30' of the adhesive area 30. However, in the region of the outer parts 30''' the lower-web section 25 is free of separating agent and is thereby bonded firmly with the upper-web section 24'', forming an attachment bridge.

In the second embodiment, as in the first embodiment, after any desired printing has been performed on the strip baggage tag 21, the tag part 26 and the control section 27 are grasped by hand and detached along the separation line 28. This separation is readily possible since the two adhesive areas 29 and 30 are each spaced a certain distance from the separation line 28. The lower-web section 25 extends in the opposite direction (to the left in the figure) beyond the adhesive area 29, so that, here also, it is easy to detach the lower-web section 25 in order to expose the adhesive areas.

Figure 9:
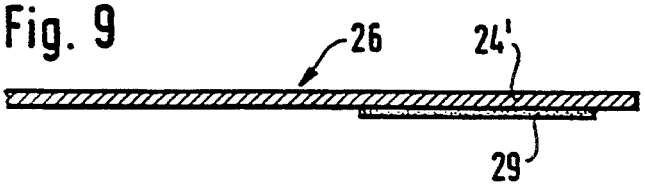
FIG. 9 is a longitudinal section through the tag part which is to be attached to the bag after removal of the control section.
Figure 10A:
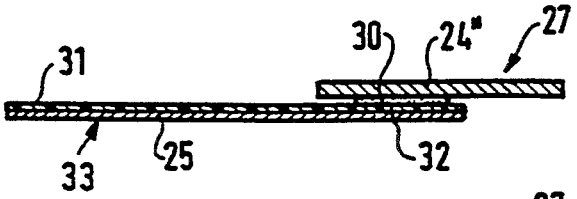
FIGS. 10*a* and 10*b* are longitudinal sections through the detached control section in different states of use.
Figure 10B:
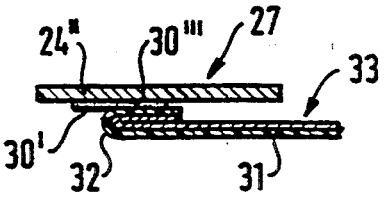

The tag part 26 bearing the activated adhesive area 29, shown in partial longitudinal section in FIG. 9, can be placed around the handle of a bag, and bonded to itself to form a loop. The control section 27, after it has been detached from the tag part 26, has the shape shown in FIG. 10a, in which the tear-off part 24'' is bonded firmly at the two partial regions 30''' to the lower-web section 25 outside the separation-active region 31. A bend perforation 32 is provided in this region, which permits easy folding of the free part of the lower-web section 25, as a result of which, as shown in FIG. 10*b*, the narrower region 30' of the adhesive area 30 is activated. It is also possible to provide the back of the lower-web section 25 with an advertisement 33 or the like, as in the first embodiment.

Figures 11, 12, 13:
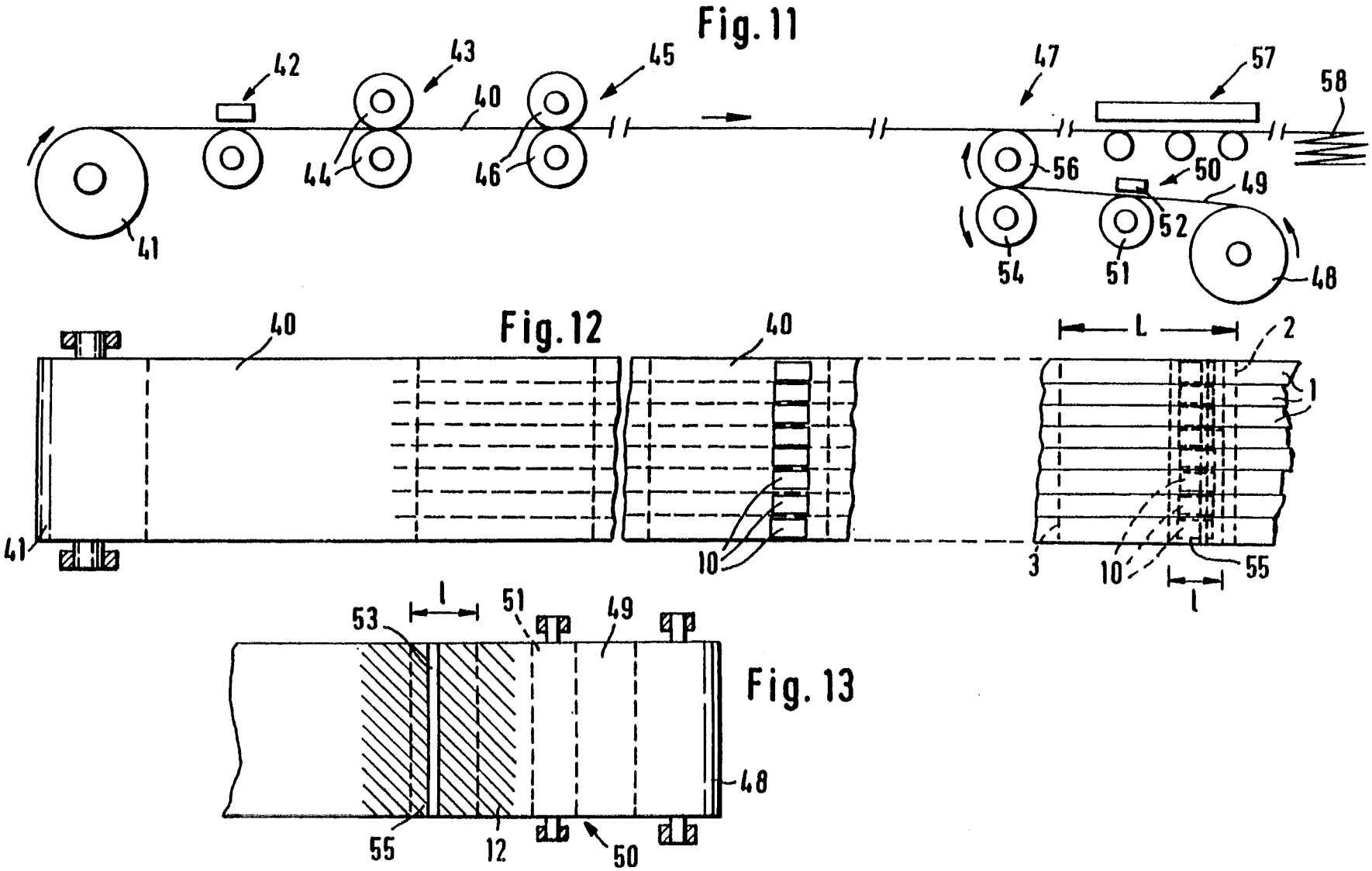
FIG. 11 shows diagrammatically the course of a method for the manufacture of a strip baggage tag according to the invention.
FIG. 12 diagrammatically shows a partial top and bottom view of FIG. 11.
FIG. 13 shows, also diagrammatically, the corona treatment of the web with the separation-active coating.

A method for the production of strip baggage tags in accordance with FIGS. 1 to 3 can be explained with reference to FIGS. 11 to 13. The strip baggage tags are produced parallel to the direction of travel of a web of material 40, the width of which is a multiple of the width of the individual strip baggage tags 1 in accordance with FIG. 1. The web of material 40 in this case, after removal from a roll 41, is provided in a first operation with a thermosensitive coating at a station 42, and may be printed at a printing station 43 by means of a pair of rolls 44.

There, in a second operation, pressure-sensitive adhesive is applied at a gluing station 45 onto the back of the web by means of a pair of rolls 46 so as to produce the adhesive areas 10. This is indicated in FIG. 12, which shows a bottom view of the web of material 40.

At a further station 47, the coated lower web section 5 is then fed in. This is effected via a web 49 bearing a separation-active coating which comes from a roller 48 and passes through a station 50 where a corona treatment is performed. This treatment station 50 comprises, for instance, an electrode roll 51 and an electrode 52, between which the continuously applied separation-active coating 12 is made separation-inactive over a transverse strip-shaped region 53 (FIG. 13). The web 49 then travels over a cutting cylinder 54 in which sections 55 are cut off from the web 49, the length L of said sections corresponding to that of the lower-web sections 5. These web sections 55 are then removed by a suction cylinder 56 and fed to the back of the web of material 40. The timing of the feeding is controlled to be such that all of the separation-inactive regions 54 of the web sections 55 come to lie below the adhesive areas 10, so that firm bonding to form the attachment bridge 13 can take place there, below the adhesive areas 10'' associated with the tear-off parts 4''.

The webs which have been brought together can then be stamped, slit, perforated and cut into individual strips in a further station 57, which has been shown merely diagrammatically, and the strips can then be deposited either as an endless stack 58 or else in the form of rolls.

As an alternative, it is also possible to apply the pressure-sensitive adhesive 10 for the production of the adhesive areas 10' and 10'', not directly to the back of the web of material 40, as described above, but, rather, to the corresponding places on the lower web 49 which has already been corona-treated, in order then, when the webs are brought together, to transfer the adhesive by a transfer process to the back of the web of material 40. A corresponding adhesive application station 45' would then be provided between the corona treatment station 50 and the station 47 where the web of material 40 and the lower-web sections 5 are brought together.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A strip baggage tag for machine printing, comprising in combination:

an upper web which defines a tag part which is to be fastened to an item of baggage, and a control section, the control section comprising a tear-off part which can be detached from the tag part along a transversely extending separation line, both the tag part and the tear-off part being provided, on the back, on both sides of the separation line, with adhesive areas which are coated with pressure-sensitive adhesive, the adhesive areas being covered by a single-piece lower-web section which has been coated with a separating agent; the width of the lower-web section corresponding to that of the upper web; and the lower-web section having, at least in the region of the adhesive area on the tear-off part, at least one partial region which is free from active separating agent and provides a firm bond between the tear-off part and the lower-web section.

2. A strip baggage tag according to claim 1, wherein the adhesive areas are applied to the upper web only in a laterally inner region, leaving narrow lateral strips free of adhesive along the longitudinal edges.

3. A strip baggage tag according to claim 2, wherein the layers of adhesive define two adhesive areas, respectively on the tag part and on the tear-off part, the adhesive area on the tear-off part forming two regions of different width, namely a narrow region of smaller width and a wide region of larger width, and the lower-web section is coated with separating agent only over a width corresponding approximately to the width of the narrow region, and is free from active separating agent adjacent at least part of the wide region extending beyond same.

4. A strip baggage tag according to claim 1, wherein the layers of adhesive form a continuous adhesive area and the region free from active separating agent of the lower-web section extends transversely over the entire width of the continuous adhesive area, the lower-web section being otherwise continuously coated with separating agent.

5. A strip baggage tag according to any one of claims 1 to 4, wherein the web section is provided with a perforation in the region of the tear-off part.

6. A strip baggage tag according to claim 5, wherein the perforation is arranged in a boundary region between the region coated with separating agent and the firm bond.

7. A continuous process for producing a strip baggage tag comprising an upper web which defines a tag part which is to be fastened to an item of baggage, and a control section, the control section comprising a tear-off part which can be detached from the tag part along a transversely extending separation line, both the tag part and the tear-off part having, on the back, and on both sides of the separation line, adhesive areas which are coated with pressure-sensitive adhesive, the adhesive areas being covered by a lower-web section which has been coated with a separating agent, comprising the steps of:

feeding a web of material, the width of which is a multiple of the width of individual strip baggage tags, from a roll;

coating the web with a thermosensitive printing material on its front side;

applying an adhesive to form the adhesive areas;

then feeding in lower-web sections which are coated with a separating agent except for partial regions where said separating agent is inactive, said feeding being from the direction of the back of the web of material, and combining the lower-web sections with the web of material.

8. A method according to claim 7, further comprising the steps of forming the lower-web sections by subjecting a lower web which is continuously coated with separating agent, in said partial regions, to a corona treatment in order to eliminate activity of the separating agent in the partial regions, and then cutting the lower web into individual lower-web sections.

9. A method according to claim 8, wherein the corona treatment and the cutting of the lower web take place shortly before the lower-web sections are combined with the web of material.

10. A method according to claim 7, wherein the adhesive which forms the adhesive areas is applied directly to the back of the web of material.

11. A method according to claim 7, wherein the adhesive which forms the adhesive areas is applied to the front of the lower web coated with separating agent and then is transferred by a transfer process to the back of the web of material.

12. A method according to claim 11, wherein after the corona treatment of the lower web bearing the separating agent coating, the adhesive is applied to it.

13. A method according to claim 7, further comprising the step of cutting the web of material in longitudinal direction into strips to form individual tags.

* * * * *